US005328343A

United States Patent [19]

Bernstrom et al.

[11] Patent Number: 5,328,343

[45] Date of Patent: Jul. 12, 1994

[54] ROTARY FLUID PRESSURE DEVICE AND IMPROVED SHUTTLE ARRANGEMENT THEREFOR

[75] Inventors: Marvin Bernstrom, Eden Prairie; Marvin Flaschenriem, Prior Lake; Oliver Johnson, Chaska; Sohan Uppal, Bloomington, all of Minn.

[73] Assignee: Eaton Corporation, Cleveland, Ohio

[21] Appl. No.: 73,838

[22] Filed: Jun. 9, 1993

[51] Int. Cl.[5] ..... F04C 3/00

[52] U.S. Cl. ..... 418/61.3; 418/132; 418/133

[58] Field of Search ..... 418/61.3, 132, 133

[56] References Cited

U.S. PATENT DOCUMENTS

| | | | |
|---|---|---|---|
| 3,338,257 | 8/1967 | Ferguson | 137/112 |
| 3,734,132 | 5/1973 | Kuhnelt | 137/625.49 |
| 3,863,449 | 2/1975 | White, Jr. | 60/456 |
| 4,343,601 | 8/1982 | Thorson | 418/61 |
| 4,696,161 | 9/1987 | Rasmussen et al. | 418/61.3 |
| 4,762,479 | 8/1988 | Uppal | 418/61.3 |
| 4,976,594 | 12/1990 | Bernstrom | 418/61.3 |

*Primary Examiner*—Richard A. Bertsch
*Assistant Examiner*—Charles G. Freay
*Attorney, Agent, or Firm*—L. J. Kasper

[57] ABSTRACT

A gerotor motor (11) of the valve-in in-star type is provided wherein a stationary valve member (17) is disposed immediately adjacent the gerotor gear set (19). The stationary valve member defines a shuttle bore (81) and disposed therein is a shuttle member (107) which moves between two operating positions (FIGS. 6 and 7) under the influence of system pressure. The shuttle valve member (107) communicates system pressure from whichever of the ports (39 or 41) is at high pressure to a pressure balancing recess (63). At the same time, the shuttle valve (107) provides fluid communication between whichever of the ports is at low pressure and a low pressure passage (83) which may be in communication with a lubrication circuit (95), or may be in communication with a case drain port, to divert a small amount of fluid to a heat exchanger. The invention provides a very small shuttle valve arrangement comprising only a single part, and eliminating a substantial amount of the machining previously required in the motor endcap (15).

10 Claims, 4 Drawing Sheets

ROTARY FLUID PRESSURE DEVICE AND IMPROVED SHUTTLE ARRANGEMENT THEREFOR

BACKGROUND OF THE DISCLOSURE the present invention relates to rotary fluid pressure devices, and more particularly, to such devices of the type which typically include a gerotor gear set, and a stationary valve member disposed adjacent the gerotor gear set.

Rotary fluid pressure devices which include a gerotor gear set as the fluid displacement mechanism are typically used as low-speed, high-torque motors. Such gerotor motors have traditionally been classified as being either of the "spool valve" type, or of the "disc valve" type. In a spool valve gerotor motor, the valving is accomplished at a cylindrical interface between a spool valve and a surrounding housing. In a disc valve type, the valving is accomplished at a flat, transverse planar interface of a disc valve and a stationary valve member.

More recently, a particular type of disc valve motor has been developed which is sometimes referred to as a "valve-in-star" motor. In this type of motor, a disc valve element is recessed within one axial end face of the gerotor star, and the valving action occurs between the axial end surface of the star and disc valve and the adjacent surface of a stationary valve member. Such valve-in-star motors are illustrated and described in U.S. Pat. Nos. 4,715,798; 4,741,681; 4,756,676; and 4,976,594, all of which are assigned to the assignee of the present invention and incorporated herein by reference.

It should be understood by those skilled in the art that, although the present invention is not limited to use in rotary fluid pressure devices of the valve-in-star type, the invention is especially suited for use in conjunction with such devices, and will be described in connection therewith.

Many gerotor motors of the type sold commercially by the assignee of the present invention include some sort of shuttle valve. In some motors, the only purpose for the shuttle valve is to communicate a relatively small flow of fluid from the low pressure side (downstream of the gerotor) of the motor to a case drain port, from where the fluid flows through a heat exchanger, to prevent overheating of the system fluid. Such shuttle valves are typically located in the endcap casting which defines the inlet and outlet ports of the motor. A typical shuttle valve of the type and for the purpose described above, and which is in commercial usage by the assignee of the present invention is illustrated and described in U.S. Pat. No. 4,343,601, assigned to the assignee of the present invention and incorporated herein by reference.

In some gerotor motors, a shuttle valve arrangement is included to divert a relatively small lubricant flow from the main flow path, and direct the lubricant flow through various parts of the motor which need lubrication, such as spline connections and bearings. An example of a gerotor motor including a shuttle valve used to divert lubricant flow is illustrated and described in U.S. Pat. No. 4,645,438, assigned to the assignee of the present invention and incorporated herein by reference.

Finally, in gerotor motors of the valve-in-star type, in which there is a stationary valve plate disposed adjacent the gerotor, the side of the stationary valve plate axially opposite the gerotor typically defines a pressure balancing region, as is illustrated and described in above-incorporated U.S. Pat. No. 4,976,594. In such motors, assuming bi-directional operation is desired, it is necessary to provide some means to communicate system pressure (the pressure at the inlet port of a motor) to the pressure balancing region, in order to bias the stationary valve member into sealing engagement with the adjacent surface of the gerotor and valve-in-star. This is done to reduce leakage along the face of the gerotor and improve volumetric efficiency of the motor.

In motors of the type shown in above-incorporated U.S. Pat. No. 4,976,594, the shuttle valve has been disposed in the endcap casting, and has typically included the assembly of spools, poppet members, sleeves, springs, and plug members illustrated and described in above-incorporated U.S. Pat. No. 4,343,601. Although such shuttle valve arrangements have generally performed satisfactorily for the intended purpose, the substantial number of parts in the shuttle assembly, and the extra machining required in the endcap casting has added substantially to the size, complexity, and expense of the entire endcap assembly, thus increasing the overall size, weight, and expense of the entire motor.

In addition, the use in valve-in-star motors of the type of shuttle arrangement illustrated and described in above-incorporated U.S. Pat. No. 4,343,601 has been used only to provide low pressure fluid to the lubrication circuit, and from there the fluid flows to a case drain, and then to the system cooler. Communicating high pressure fluid to the pressure balancing region has required additional structure.

SUMMARY OF THE INVENTION

Accordingly, it is an object of the present invention to provide an improved rotary fluid pressure device of the gerotor type including a shuttle valve arrangement which does not have to be located in the endcap casting, and eliminates the substantial extra machining required in connection with the prior art shuttle valve arrangements.

It is another object of the present invention to provide an improved rotary fluid pressure device which accomplishes the above-stated object, and which makes it possible to eliminate the multiplicity of parts used in the typical prior art shuttle valve arrangement.

It is still another object of the present invention to provide such an improved device and shuttle valve arrangement therefor which is operable to provide both high pressure, e.g., for pressure balancing, as well as low pressure for either lubrication or cooling, and to do so for either direction of operation of the device.

The above and other objects of the invention are accomplished by the provision of an improved rotary fluid pressure device of the type including housing means defining first and second fluid ports, a rotary fluid displacement mechanism including an internally-toothed member and an externally-toothed member, eccentrically disposed within the internally-toothed member for relative orbital and rotational movement therebetween. The teeth of the members interengage to define expanding and contracting fluid volume chambers in response to the orbital and rotational movement. Valve means cooperates with the housing means to define a main fluid path operable to provide fluid communication between the first port and the second port, through the fluid displacement mechanism. An input-output shaft means is included, and means operable to transmit torque between the externally-toothed member and the input-output shaft means. The valve means includes a stationary valve member comprising a plate-like member disposed immediately adjacent the internally-and externally-toothed members, and having a sealing surface disposed adjacent thereto. A stationary valve member has an axially opposite balancing surface disposed to be subject to fluid pressure in a pressure balancing chamber cooperatively defined by the housing means and the stationary valve member. Shuttle valve means is operable to communicate fluid pressure from the main fluid path to the pressure balancing chamber.

The improved rotary fluid pressure device is characterized by the stationary valve member defining a shuttle bore disposed axially adjacent the pressure balancing chamber, and in open fluid communication therewith. A shuttle valve member is slidably disposed in the shuttle bore and cooperates therewith to define first and second chambers disposed on axially opposite ends of the shuttle valve member. The stationary valve member defines a lubrication passage communicating with the shuttle bore axially intermediate the first and second chambers. A first passage means provides fluid communication between the first port and the first chamber, and a second passage means provides fluid communication between the second port and the second chamber.

The shuttle valve member is configured such that:

(i) when the first fluid port contains high pressure, the shuttle valve member is biased to a first position in which the shuttle valve member provides fluid communication between the first chamber and the pressure balancing chamber, and between the second passage means and the lubrication passage; and (ii) when the second fluid port contains high pressure, the shuttle valve member is biased to a second position in which the shuttle valve member provides fluid communication between the second chamber and the pressure balancing chamber, and between the first passage means and the lubrication passage.

DESCRIPTION OF THE PREFERRED EMBODIMENT

Figure 1:
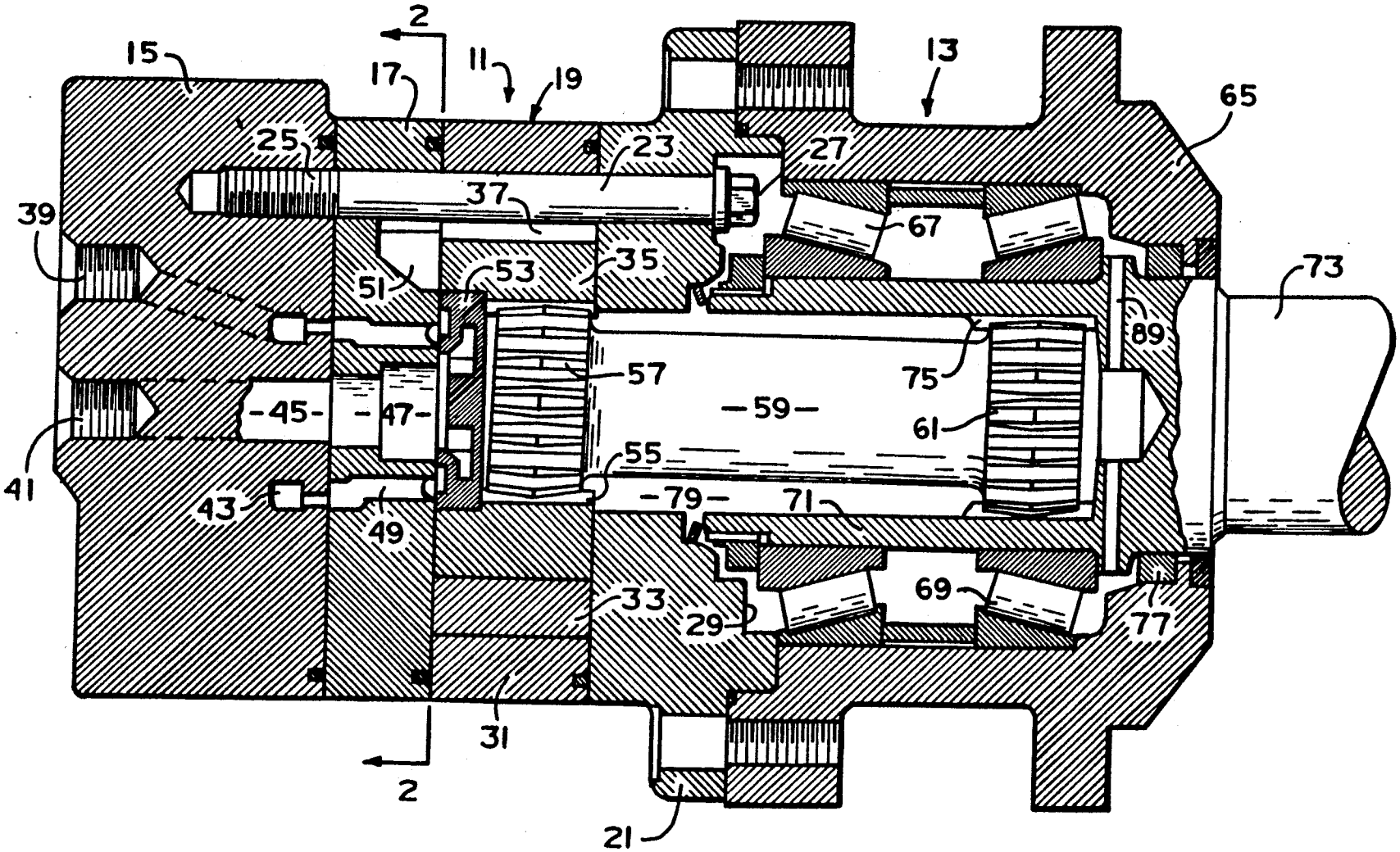
FIG. 1 is an axial cross-section of a valve-in-star gerotor motor of the type with which the present invention may be utilized, taken on line 1—1 of FIG. 2.

Referring now to the drawings, which are not intended to limit the invention, FIG. 1 illustrates a valve-in-star gerotor motor of the type with which the present invention may be utilized, the motor being generally designated 11. Preferably, the gerotor motor 11 shown in FIG. 1 is of the type illustrated and described in the above-incorporated valve-in-star motor patents. Furthermore, the motor shown in FIG. 1 is of the particular construction illustrated and described in co-pending application U.S. Ser. No. 943,269, (now U.S. Pat. No. 5,211,551) filed Sep. 10, 1992 in the names of Sohan L. Uppal and Gary R. Kassen, for a "MODULAR MOTOR", assigned to the assignee of the present invention and incorporated herein by reference.

The modular, gerotor motor 11, which will be described only briefly herein in view of above-incorporated U.S. Pat. No. 4,976,594, includes an endcap 15, a stationary valve plate 17 defining a sealing surface 18, a gerotor gear set, generally designated 19, and a flange member 21. The elements 15 through 21 are held in tight sealing engagement by means of a plurality of bolts 23 (see also FIG. 2). Each of the bolts 23 includes a threaded portion 25, in threaded engagement with an internally threaded bore defined by the endcap 15. Each of the bolts 23 also includes a head 27 disposed in engagement with a forward surface 29, defined by the flange member 21 (shown only in FIG. 1).

The gerotor gear set 19 may be of the type well known in the art, and includes an internally-toothed ring member 31 defining a plurality of generally semi-cylindrical openings, with a cylindrical roller member 33 being disposed in each of the openings, and serving as the internal teeth of the ring member 31. Eccentrically disposed within the ring member 31 is an externally-toothed star member 35, which typically has one less external tooth than the number of the internal teeth 33, thus permitting the star 35 to orbit and rotate relative to the ring 31, as is well known to those skilled in the art. The orbital and rotational movement of the star 35 within the ring 31 defines a plurality of expanding and contracting fluid volume chambers 37.

The endcap 15 defines a fluid inlet port 39 and a fluid outlet port 41, the inlet port 39 being in fluid communication with an annular fluid chamber 43, and the outlet port 41 being in fluid communication with a fluid chamber 45. Those skilled in the art will understand that, in order to reverse the rotational direction of operation of the motor assembly 11, the port 41 can become the inlet port, while the port 39 becomes the outlet port, i.e., the direction of fluid flow through the motor is reversed.

The stationary valve plate 17 defines a central fluid passage 47, in communication with the chamber 45, and a plurality of fluid passages 49, each of which is in communication with the annular fluid chamber 43. The valve plate 17 also defines a plurality of valve passages 51, each of which is in continuous fluid communication with one of the expanding and contracting fluid volume chambers 37. The rearward portion of the star 35 defines a counterbore within which is disposed a valve member 53. The details of the valve member 53 are not an essential feature of the present invention, but are illustrated and described in detail in several of the above-incorporated patents. It is sufficient to note that, as the star 35 orbits and rotates within the ring 31, the valve member 53 achieves commutating fluid communication of high pressure inlet fluid from the inlet port 39 to the expanding volume chambers 37, and commutating fluid communication of low pressure outlet fluid from the contracting fluid volume chambers 37 to the outlet port 41.

The star 35 defines a set of internal splines 55, which are in engagement with a set of external, crowned splines 57 formed on the rearward end of a main drive shaft 59. Disposed at the forward end of the driveshaft 59 is another set of external, crowned splines 61. The main driveshaft 59 is also referred to as a "dogbone" shaft or a "wobble" shaft by those skilled in the art. The function of the shaft 59 is to receive the rotational component of the movement of the star 35 (which also has an orbital component of its movement), and transmit that rotational component to an element of the forward bearing package 13, which has only rotational motion.

As may be seen best in FIGS. 6 and 7, the stationary valve plate 17 defines a pressure balancing recess 63 (also referred to hereinafter as a "groove" or "chamber") the construction and function of which is illustrated and described in great detail in above-incorporated U.S. Pat. No. 4,976,594. The "modular" and "wet bolt" construction shown herein is especially advantageous when used in a motor configuration such as that shown in FIG. 1.

Referring again to FIG. 1, the forward bearing package 13 defines a bearing housing 65 within which is disposed a pair of tapered, roller bearings 67 and 69. The bearings 67 and 69 support a hollow, generally cylindrical portion 71 of an output shaft 73. The portion 71 defines a set of internal, straight splines 75, which are in splined engagement with the external crowned splines 61, in a known manner. Disposed between the output shaft 73 and the bearing housing 65 is an annular seal assembly 77, such that the output shaft 73 and the housing 65 cooperate to define, in cooperation with the modular motor assembly 11, a sealed cavity 79.

Figure 2:
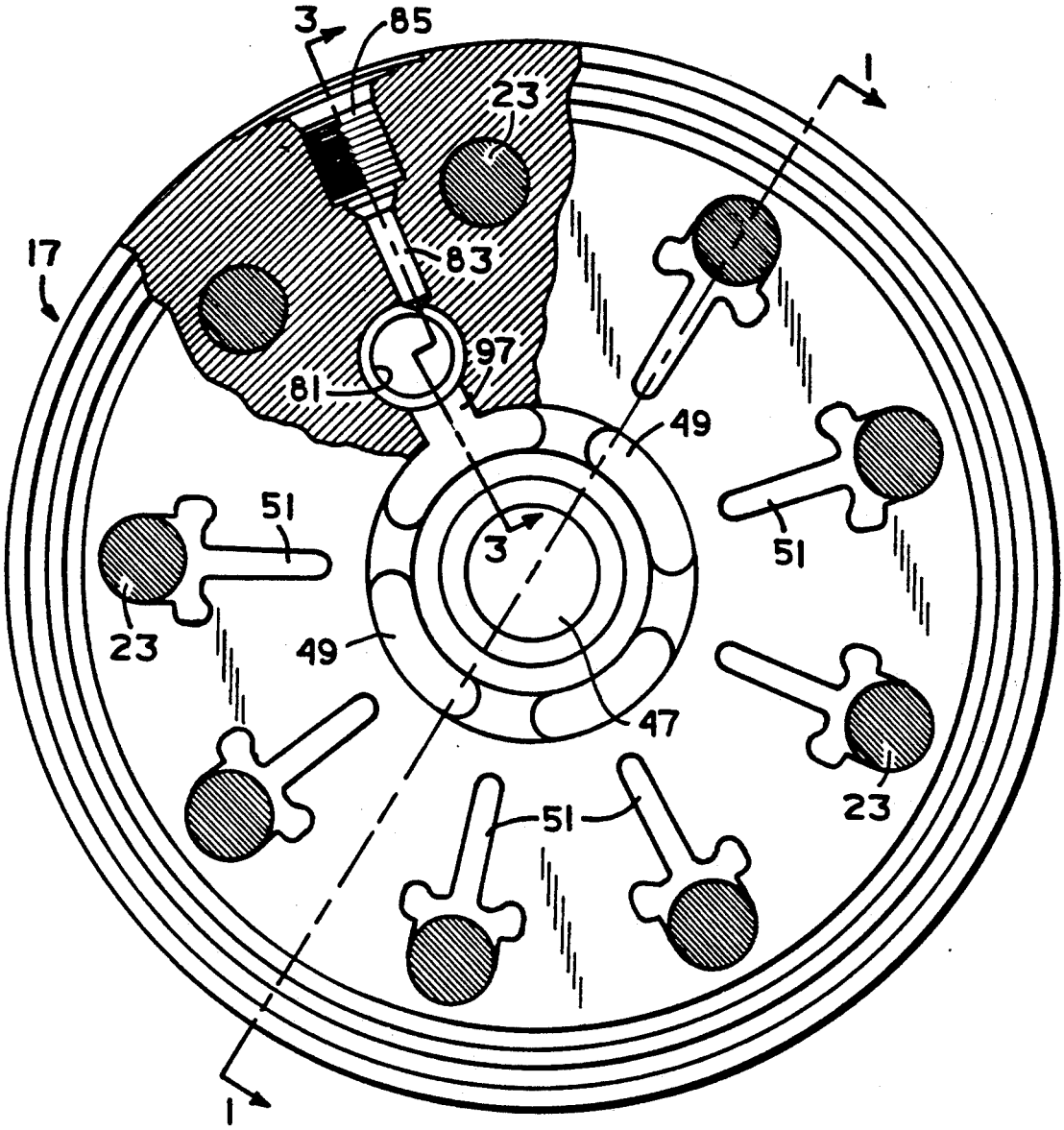
FIG. 2 is a transverse cross-section, partly in plan view, and partly in broken-away section, taken on line 2—2 of FIG. 1, and on a somewhat larger scale than FIG. 1.
Figure 3:
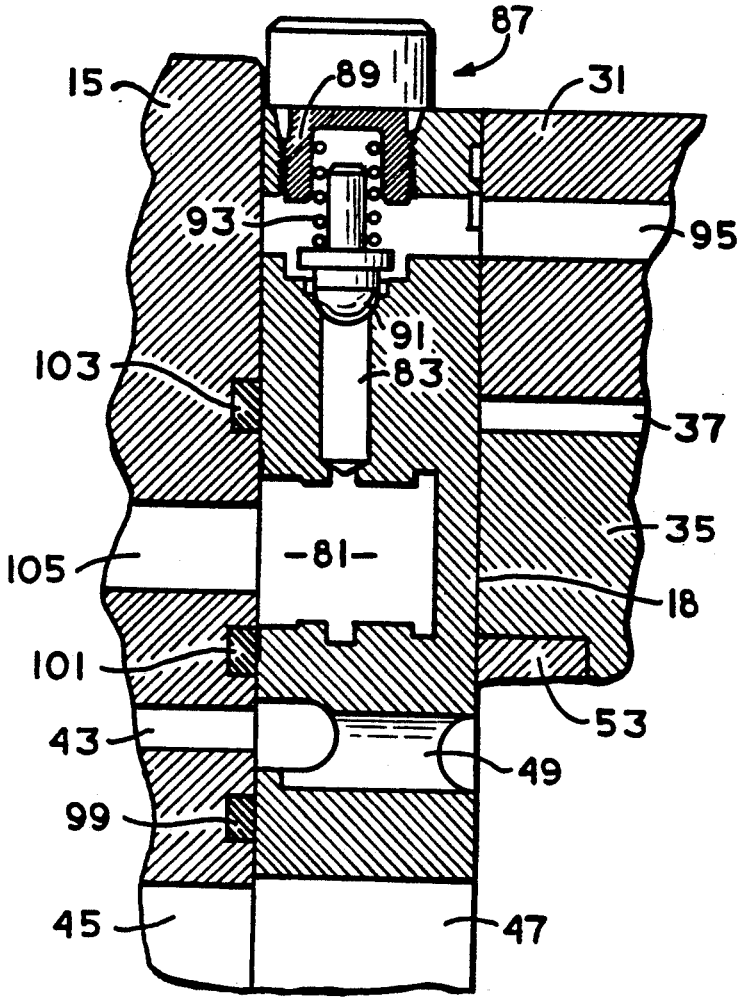
FIG. 3 is an enlarged, fragmentary, axial cross-section, taken on line 3—3 of FIG. 2, and illustrating one aspect of the present invention.

Referring now primarily to FIG. 2, in conjunction with FIG. 3, the valve plate 17 defines an axially-oriented, generally cylindrical shuttle bore 81 which, as may best be seen in FIG. 3, is open at its left end in FIG. 3, i.e., at the end adjacent the endcap 15. However, the shuttle bore 81 does not extend through to the surface adjacent the ring 31 and star 35. Extending generally radially outward from the shuttle bore 81 is a lubricant passage 83, which terminates, at its radially outer end, in a threaded opening 85 (see FIG. 2). As may be seen only in FIG. 3, disposed within the threaded opening 85 is a backpressure valve assembly, generally designated 87, which comprises a threaded plug 89, in threaded engagement with the opening 85. The backpressure valve assembly 87 further comprises a poppet member 91 which is normally biased toward its poppet seat by means of a compression spring 93. In the position shown in FIG. 3, the poppet member 91 blocks fluid flow, below a predetermined pressure, from the lubricant passage 83 to a lubricant passage 95, which extends axially through the gerotor ring 31, and can thereafter communicate with any one of a number of well known types of lubrication circuits. Alternatively, the passage 95 could be connected to a case drain port (not shown herein) which in turn could be connected to a heat exchanger, as was described in the BACKGROUND OF THE DISCLOSURE. As may best be seen in FIGS. 2, 6, and 7, the shuttle bore 81 is in fluid communication with one of the fluid passages 49, by means of an angled passage 97, the purpose of which will be described subsequently.

Referring again primarily to FIG. 3, the endcap 15 defines three annular, concentric grooves within which are disposed O-rings 99, 101, and 103 (moving progressively radially outward). The function of the O-ring 99 is simply to prevent cross-port leakage between the fluid chamber 45 which communicates with the outlet port 41, and the fluid chamber 43, which communicates with the inlet port 39.

Figure 7:
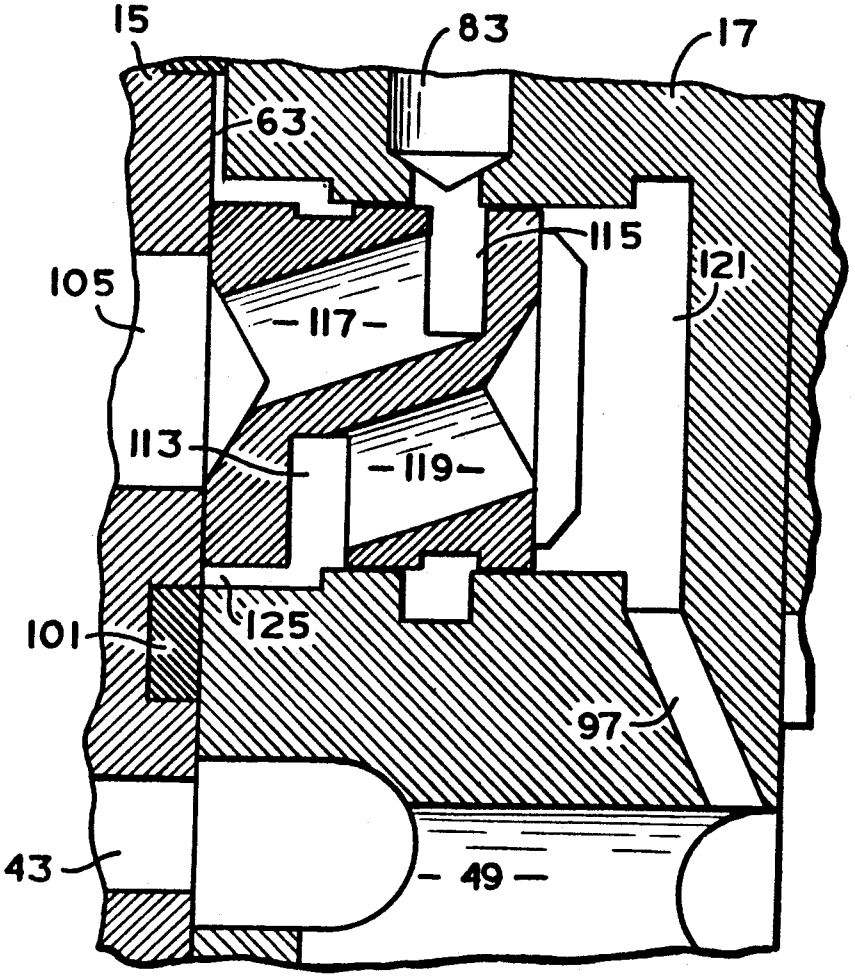
FIG. 7 is a fragmentary, axial cross-section, similar to FIG. 6, but on a still larger scale, illustrating another operating position of the shuttle valve arrangement of the present invention.
Figure 6:
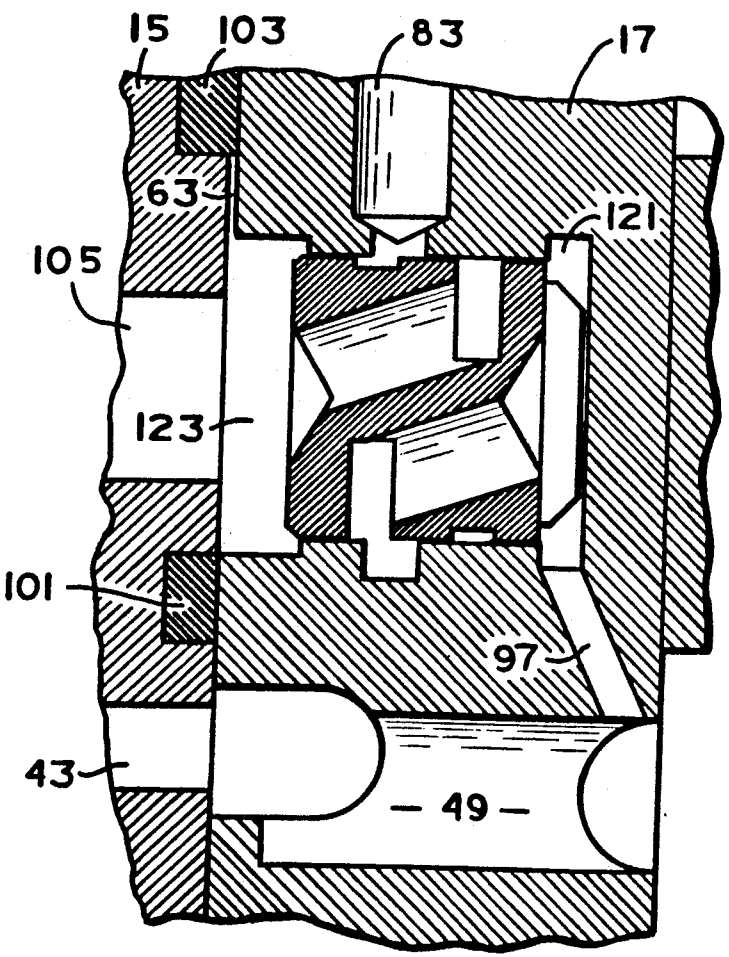
FIG. 6 is a fragmentary, axial cross-section, similar to FIG. 3, but on a somewhat larger scale, illustrating one operating position of the shuttle valve arrangement of the present invention.

The O-rings 101 and 103 define, radially therebetween, the pressure balancing recess 63 (see FIGS. 6 and 7). The only "interruption" in the pressure balancing recess 63 is a passage 105, which is disposed adjacent the end of the shuttle bore 81. The passage 105 is in relatively open, unrestricted fluid communication with either the outlet port 41 or the fluid chamber 45, and therefore, is always at substantially the same pressure as the chamber 45. The functioning of the pressure balancing recess 63 is illustrated and described in detail in above-incorporated U.S. Pat. No. 4,976,594, and will be described only briefly herein. The annular pressure balancing recess 63 always contains substantially system pressure (high pressure), which is the higher of the pressures in the ports 39 and 41. By way of example only, with the device of the present invention being utilized as a motor, and the port 39 serving as the inlet port, inlet pressure in the port 39 would be communicated to the pressure balancing recess 63. How this is accomplished will be described subsequently.

Figure 4:
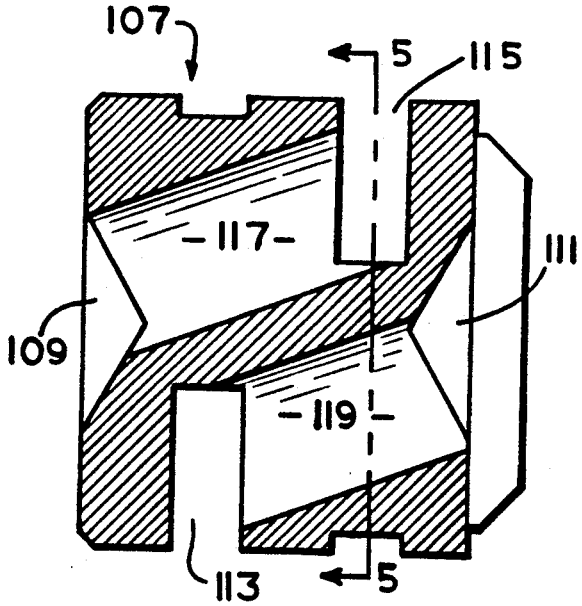
FIG. 4 is a further enlarged, axial cross-section of the shuttle valve member of the present invention.
Figure 5:
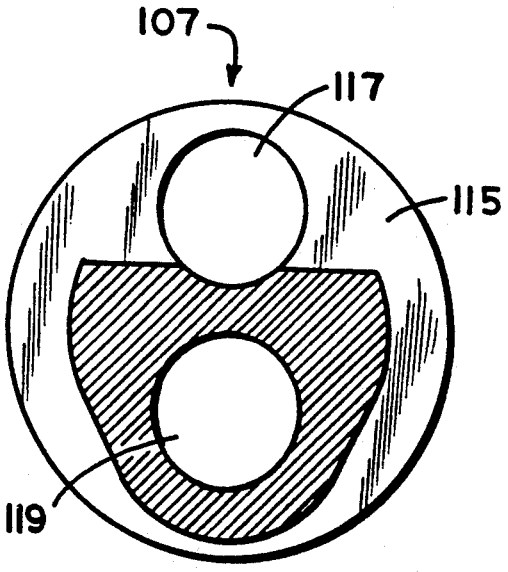
FIG. 5 is a transverse cross-section, taken on line 5—5 of FIG. 4, and on the same scale as FIG. 4.

Referring now to FIGS. 4 and 5, there is illustrated a shuttle valve member, generally designated 107, which comprises one important aspect of the present invention. The shuttle valve 107 comprises a generally cylindrical member defining a forward, generally conical recess 109 and a rearward generally conical recess 111. The shuttle valve 107 further defines a generally annular, irregular forward groove 113, and a generally annular, irregular rearward groove 115 (also shown in FIG. 5). It should be noted that, if a transverse section similar to FIG. 5 were taken through the forward groove 113, but looking to the right in FIG. 4, the view would look identical to FIG. 5, but turned upside-down, i.e., with the radially narrowest portion of the forward groove 113 on top (the narrowest portion of rearward groove 115 is on the bottom in FIG. 5).

The shuttle valve 107 further defines an angled passage 117 which interconnects the conical recess 109 and the rearward groove 115, and an angled passage 119 which interconnects the conical recess 111 and the forward groove 113. The purpose of the various recesses, grooves, and passages will be described subsequently.

Referring now primarily to FIGS. 6 and 7, the invention will be described in connection with each of two primary operating positions of the shuttle valve member 107 within the shuttle bore 81. Those skilled in the art will understand that the shuttle valve 107 may, at various times, have intermediate positions, between the two extremes shown in FIGS. 6 and 7, but such intermediate positions would be only transient positions, and during most of the time that the motor 11 is operating, the shuttle valve assembly 107 will be in either the position shown in FIG. 6 or the position shown in FIG. 7.

Referring first to FIG. 6, whenever the port 41 receives high pressure fluid (thus becoming the "inlet" port), high pressure is communicated also into the passage 105, and biases the shuttle valve 107 against the "bottom" (right end) of the bore 81, thus creating a chamber 121 at the right end of the shuttle valve 107, and a chamber 123 at the left end of the shuttle valve 107. Thus, there is high pressure in the conical recess 109, the angled passage 117, and the rearward groove 115, but the groove 115 is blocked by the surface of the shuttle bore 81. As a result, high pressure is maintained in the chamber 123, and from there, enters into the pressure balancing recess 63, such that the entire recess 63 is under high (system) pressure, and the valve plate 17 is biased to the right in FIG. 6 into "sealing" engagement with the adjacent surface of the gerotor star 35. Those skilled in the art will understand that the valve plate 17 does not actually seal against the star 35, but merely takes up whatever portion of the axial clearance is desired and predetermined.

At the same time, the port 39 contains low pressure, exhaust fluid (and thus serves as the "outlet" port), such that there is low pressure in the chamber 43, the passages 49, the angled passage 97, and the chamber 121. Therefore, a small flow of low pressurize fluid passes through the angled passage 97 into the rearward recess 111, then flows forwardly through the angled passage 119 into the forward groove 113, then flows radially outward through the lubricant passage 83 which, in the position of the valve 107 shown in FIG. 6, is axially aligned with the forward groove 113.

Referring now to FIG. 7, when it is desired to operate the motor in the opposite direction, pressurized fluid is communicated to the inlet port 39, which then flows through the annular chamber 43, and through the fluid passages 49. Thus, system pressure is present in the angled passage 97, and biases the shuttle valve 107 to the left in FIG. 7 to the position shown, in sealing engagement with the adjacent surface of the endcap 15, i.e., the surface surrounding the passage 105. At the same time, low pressure, exhaust fluid is flowing from the central passage 47, through the chamber 45 to the outlet port 41, and therefore, the passage 105 also contains low pressure, exhaust fluid. With the shuttle valve 107 sealed against the endcap 15, a small flow of low pressure fluid will flow from the passage 105 through the forward conical recess 109, then through the angled passage 117 into the rearward groove 115, which is now aligned with the lubricant passage 83.

With the shuttle valve 107 biased to the position shown in FIG. 7, the high pressure in the chamber 121 flows through the rearward recess 111, through the angled passage 119, and into the forward groove 113. The groove 113 is in open communication with a forward, enlarged portion 125 of the shuttle bore 81. Thus, high pressure is communicated from the groove 113 through the portion 125 into the pressure balancing recess 63, biasing the valve plate 17 to the right in FIG. 7, in the same manner as described previously.

Although the present invention has been described in connection with an embodiment in which the lubricant passage 83 provides lubricant to a lubricant passage 95, and then to a lube circuit, those skilled in the art should understand that the invention is not so limited. For example, it is known to those skilled in the art to divert lubricant from some other location in the main fluid path, such as from the gerotor gear set. See U.S. Pat. No. 4,533,302, assigned to the assignee of the present invention and incorporated herein by reference. Using such an arrangement, lube would flow from the gerotor gear set 19 through the various spline connections and bearing sets. It would then be preferable to have the fluid recombine with the main fluid path, downstream of the gerotor, and flow to the low pressure outlet port. Such an arrangement could be accomplished by eliminating the back pressure valve assembly 87, but plugging the threaded opening 85. Returning lube flow would then flow to the lubricant passage 95, then radially inward through the lubricant passage 83 toward the shuttle bore 81. With the shuttle valve in the position shown in FIG. 6, returning lube flow would flow into the annular groove 113, then through the angled passage 119 into the chamber 121, and from there through the passage 97 and the passage 49 to the port 39.

With the shuttle valve 107 in the position shown in FIG. 7, returning lube would flow into the annular groove 115, then through the angled passage 117 into the passage 105, and from there to the port 41.

Thus, it may be seen that the present invention provides a shuttle valve assembly which is operable to communicate high pressure to a pressure balancing area, (a high pressure location), and communicate low pressure to the location in which it is needed, or from the location from which it is returning (a low pressure location). Furthermore, the shuttle valve of the present invention is extremely simple, comprising only a single part, and eliminating most of the machining formerly required in the endcap.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. A rotary fluid pressure device of the type including housing means defining a first fluid port and a second fluid port; a rotary fluid displacement mechanism including an internally-toothed member and an externally-toothed member eccentrically disposed within said internally-toothed member for relative orbital and rotational movement therebetween; the teeth of said members interengaging to define expanding and contracting fluid volume chambers in response to said orbital and rotational movement; valve means cooperating with said housing means to define a main fluid path operable to provide fluid communication between said first fluid port and said second fluid port through said fluid displacement mechanism; input-output shaft means and means operable to transmit torque between said externally-toothed member and said input-output shaft means; said valve means including a stationary valve member comprising a plate-like member disposed immediately adjacent said internally- and externally-toothed members and having a sealing surface disposed adjacent thereto; said stationary valve member having an axially opposite balancing surface disposed to be subject to fluid pressure in a pressure balancing chamber cooperatively defined by said housing means and said stationary valve member; shuttle valve means operable to communicate fluid pressure from said main fluid path to said pressure balancing chamber; characterized by:

(a) said stationary valve member defining a shuttle bore disposed axially adjacent said pressure balancing chamber, and in open fluid communication therewith;

(b) a shuttle valve member slidably disposed in said shuttle bore, and cooperating therewith to define first and second chambers disposed on axially opposite ends of said shuttle valve member;

(c) said stationary valve member defining a lubrication passage communicating with said shuttle bore axially intermediate said first and second chambers;

(d) first passage means providing fluid communication between said first fluid port and said first chamber, and second passage means providing fluid communication between said second fluid port and said second chamber;

(e) said shuttle valve member being configured such that:

(i) when said first fluid port contains high pressure, said shuttle valve member is biased to a first position, in which said shuttle valve member provides fluid communication between said first chamber and said pressure balancing chamber, and between said second passage means and said lubrication passage and (ii) when said second fluid port contains high pressure, said shuttle valve member is biased to a second position in which said shuttle valve member provides fluid communication between said second chamber and said pressure balancing chamber, and between said first passage means and said lubrication passage.

2. A rotary fluid pressure device as claimed in claim 1, characterized by said shuttle valve member having a first end recess in fluid communication with said first chamber, and a second end recess in fluid communication with said second chamber.

3. A rotary fluid pressure device as claimed in claim 2, characterized by said shuttle valve member defining a first annular groove in fluid communication with said first end recess, and a second annular groove in fluid communication with said second end recess.

4. A rotary fluid pressure device as claimed in claim 3, characterized by said first and second annular grooves being disposed such that when said shuttle valve member is in said first position, said second annular groove is in fluid communication with said lubrication passage, and when said shuttle valve member is in said second position, said first annular groove is in fluid communication with said lubrication passage.

5. A rotary fluid pressure device as claimed in claim 1, characterized by said shuttle valve member being biased to said first position solely by fluid pressure in said first chamber, and being biased to said second position solely by fluid pressure in said second chamber.

6. A rotary fluid pressure device as claimed in claim 1, characterized by said second passage means being in open fluid communication with said pressure balancing chamber when said shuttle valve member is in said second position, said shuttle valve member preventing fluid communication between said second passage means and said pressure balancing chamber when said shuttle valve member is in said first position.

7. A rotary fluid pressure device as claimed in claim 1, characterized by said device defining a lubrication circuit, including said means operable to transmit torque between said externally-toothed member and said input-output shaft means, said lubrication passage and said shuttle valve member providing fluid communication between said lubrication circuit and whichever of said first and second fluid ports contains low pressure.

8. A rotary fluid pressure device of the type including housing means defining a first fluid port and a second fluid port; a rotary fluid displacement mechanism including an internally-toothed member and an externally-toothed member eccentrically disposed within said internally-toothed member for relative orbital and rotational movement therebetween; the teeth of said members interengaging to define expanding and contracting fluid volume chambers in response to said orbital and rotational movement; valve means cooperating with said housing means to define a main fluid path operable to provide fluid communication between said first fluid port and said second fluid port through said fluid displacement mechanism; input-output shaft means and means operable to transmit torque between said externally-toothed member and said input-output shaft means; said valve means including a stationary valve member comprising a plate-like member disposed immediately adjacent said internally- and externally-toothed members and having a sealing surface disposed adjacent thereto; said device defining a high pressure location and a low pressure location; shuttle valve means operable to communicate fluid pressure from said main fluid path to said high pressure and low pressure locations; characterized by:

(a) said housing means defining a shuttle bore;

(b) said shuttle bore being in fluid communication with said high-pressure location;

(c) said shuttle bore being in fluid communication with said low-pressure location;

(d) a shuttle valve member slidably disposed in said shuttle bore, and cooperating therewith to define first and second chambers disposed on axially opposite ends of said shuttle valve member;

(e) first passage means providing fluid communication between said first fluid port and said first chamber, and second passage means providing fluid communication between said second fluid port and said second chamber;

(f) said shuttle valve member being configured such that:

(i) when said first fluid port contains high pressure, said shuttle valve member is biased to a first position, in which said shuttle valve member provides fluid communication between said first chamber and said high pressure location, and between said second passage means and said low pressure location; and (ii) when said second fluid port contains high pressure, said shuttle valve member is biased to a second position in which said shuttle valve member provides fluid communication between said second chamber and said high pressure location, and between said first passage means and said low pressure location.

9. A rotary fluid pressure device as claimed in claim 8, characterized by said shuttle valve member being biased to said first position solely by fluid pressure in said first chamber, and being biased to said second position solely by fluid pressure in said second chamber.

10. A rotary fluid pressure device as claimed in claim 8, characterized by said device defining a lubrication circuit comprising said low pressure location, said lubrication circuit including said means operable to transmit torque between said externally-toothed member and said input-output shaft means, said passage means and said shuttle valve member providing fluid communication between said lubrication circuit and whichever of said first and second fluid ports contains low pressure.

* * * * *